US010448687B2

(12) United States Patent
Branan

(10) Patent No.: US 10,448,687 B2
(45) Date of Patent: Oct. 22, 2019

(54) ADAPTIVE CLOTHING USING MAGNETIC CLOSURES

(71) Applicant: Kristen L. Branan, Playa Vista, CA (US)

(72) Inventor: Kristen L. Branan, Playa Vista, CA (US)

( * ) Notice: Subject to any disclaimer, the term of this patent is extended or adjusted under 35 U.S.C. 154(b) by 0 days.

(21) Appl. No.: 15/907,827

(22) Filed: Feb. 28, 2018

(65) Prior Publication Data

US 2019/0261710 A1 Aug. 29, 2019

(51) Int. Cl.
*A41F 1/00* (2006.01)
*A41B 1/10* (2006.01)

(52) U.S. Cl.
CPC ..... *A41F 1/002* (2013.01); *A41B 1/10* (2013.01); *A44D 2203/00* (2013.01)

(58) Field of Classification Search
CPC ... A41F 1/002; A41F 1/00; A41F 1/04; A44D 2203/00; A41B 1/10; A41D 1/18; A41D 2300/30; A44B 1/02; A44B 17/00; Y10T 24/32
See application file for complete search history.

(56) References Cited

U.S. PATENT DOCUMENTS 2,319,292 A * 5/1943 Boggs ..... A41D 3/08 135/119
2,389,298 A * 11/1945 Ellis ..... A41F 1/002 101/389.1
4,249,267 A * 2/1981 Voss ..... A41F 1/002 2/121
6,378,174 B1 * 4/2002 Wong ..... A41F 1/002 24/303
7,806,309 B2 * 10/2010 Korchmar ..... A45C 3/06 224/183
9,210,953 B2 * 12/2015 Horton ..... A41B 1/10
9,572,386 B1 * 2/2017 Scheer ..... A41D 11/00
10,342,299 B2 * 7/2019 Reiter ..... A44B 17/0041
2002/0178551 A1 * 12/2002 Hsu ..... A41F 1/002 24/303
2003/0019008 A1 * 1/2003 Prather ..... A41F 1/002 2/69
2014/0130228 A1 * 5/2014 Horton ..... A41F 1/002 2/69

* cited by examiner

*Primary Examiner* — Amy Vanatta
(74) *Attorney, Agent, or Firm* — Continuum Law; Robert P. Cogan

(57) ABSTRACT

In adaptive clothing, magnetic members engage to magnetically fasten a lower front layer and an upper front layer. A first magnetic member is provided in a housing having a base extending beyond the boundaries of the magnet. The base is sewn to fabric. The housing is secured in a placket to be affixed to a garment upper layer. A second magnetic member is placed in an interior enclosure of a lower front layer. A button or other component is secured to the exterior side of the upper front layer to provide the appearance of a buttoned placket. To close the garment, the first magnetic member is brought in proximity to the second magnetic member. The placket may be constructed as a separate unit and attached to the garment in a separate operation, allowing construction of the placket without manipulating the entire garment. Cuffs are prepared in a manner similar to the placket.

20 Claims, 7 Drawing Sheets

ADAPTIVE CLOTHING USING MAGNETIC CLOSURES

FIELD OF THE INVENTION

The present subject matter relates generally to adaptive clothing incorporating magnetic fasteners.

BACKGROUND

Adaptive clothing is clothing that is specifically designed to facilitate a user's ability to dress when the user has diminished physical capability or dexterity generally required to manipulate features of clothing such as buttons. Adaptive clothing has been designed for people with such conditions as arthritis, oedema, Alzheimer's disease, stroke, spinal cord injury, cerebral palsy, and brain injury. Adaptive clothing includes adaptations to make clothing look conventional. Jumpsuits can be used to simulate a combination of shirt and pants. Garments that need to be opened in the back may be made to appear as standard, front-opening garments.

Structure in adaptive garments may be particularly adapted to address specific problems. Length of various sections of clothing may be increased in order to accommodate wheelchair users, for example. Clothing may be designed to be removed easily and quickly for users with incontinence. The clothing may also be designed to accommodate incontinence aids discreetly and comfortably. For users who have lost fine motor skills due to Parkinson's Disease or arthritis, for example, buttons and zippers have been replaced by magnets or hook and mesh fasteners, often referred to by the trademark Velcro®.

Using conventional clothing, the wearer must manipulate each button through a button hole. This manipulation requires a degree of manual dexterity which is beyond the capabilities of many wearers subject to the medical conditions discussed above. In adaptive clothing, the button may be affixed to the outer surface of the garment. This gives the appearance that the button is secured to a conventional "button side" and has come through a buttonhole. In order to close a garment, a user places one side over the other such that magnets or hooks and mesh are in registration and press them together to close the garment.

Different varieties of magnetic closures have been introduced in adaptive clothing. Closure simply requires placing opposite magnets, for example, in registration. Designing the closure members in adaptive clothing requires optimization of strength of the closure, simplicity in construction, and ease-of-use for the user. The prior art is discussed primarily in the context of closures which replace a button. In one form a first portion, an upper front facing, is secured to a second portion, a lower front facing. Buttons are affixed to an upper layer to give the appearance of being fastened to the lower front facing and having come through button holes. The buttons may be attached to a placket.

U.S. Pat. No. 9,210,953 discloses a system in which a button is secured on an outer surface of an upper front facing. Three layers, an outer layer, an inner layer, and a lower layer are formed by folding an end of the upper front facing back over itself. These layers define one chamber that encloses thread on a lower surface of a fabric layer having an upper surface to which a button is attached. A magnet is disposed in a second chamber. The necessity of working with folded over sections creates difficulty in maintaining alignment of the folds in order to create uniform chambers.

The complexity of this construction requires a higher level of skill of sewing machine operators and increased time and cost in manufacturing.

U.S. Pat. No. 9,717,293 discloses a magnetic fastener that permits existing garment buttons to be retrofitted for use by persons having diminished motor abilities. The magnetic button system comprises a button cover received over an existing button and having a magnet housed therein. The magnet is attracted to a magnetic or ferromagnetic element on a button hole engagement member received in a button hole of an existing garment. A separate button hole engagement member must be provided. The upper front facing will not be flush with the lower front facing because an adapter must be placed on the existing button.

U.S. Pat. No. 9,572,386 discloses a magnetic closure for clothing with non-magnetic backing. A flat, round magnet is inserted into a non-magnetic metal "cup" and enclosed entirely within a square, thin laminate covering. One flat surface of the magnet is exposed, and the opposite flat surface of the magnet is set against the inner surface of the non-magnetic metal cup. The non-magnetic metal cup serves to block or reduce the magnetic force of the surface of the flat, round magnet set against the inner surface of the cup. Such magnet, cup and laminate assemblies with exposed magnet surfaces of opposing polarities can be sewn or stitched on opposing sides of garment or clothing openings and used to close or fasten the garment or clothing utilizing magnetic force. The metal cup must be of the same size as the magnet, adding to the complexity of construction. The laminate covering is thin, e.g., <1 mm. It is simply sewn to a surface and is not part of a particular assembly.

U.S. Pat. No. 9,392,829 discloses a device for magnetic clasping for a clothing accessory including at least one permanently magnetized assembly arranged at one end of one surface of the accessory. A plurality of ferromagnetic elements are arranged longitudinally on the other surface at the opposite end thereof. The magnetized assemblies of one surface may be laterally displaced to a position on the other surface. A plurality of adjustment positions of the surfaces are obtained relative to the position of the magnetized assemblies and ferromagnetic elements, representing a plurality of possible tightness levels. This construction is complex. It is not suitable for use in a placket. In a placket, two magnetic closure elements should not have a plurality of adjustment positions.

SUMMARY

Briefly stated, in accordance with the present subject matter, adaptive clothing is provided in which magnetic members engage to magnetically fasten a lower front layer and an upper front layer. A magnet is provided in a container. The container comprises a housing for the magnet and a base extending beyond the boundaries of the housing. Extremities of the base are sewn to the fabric. The use of the container provides a simplified way of securing the magnet.

A first magnetic member is encapsulated in a housing. The housing is secured to an interior surface of the upper front layer. A second magnetic member is placed in an interior surface of the lower front layer. A button or other component is secured to the exterior side of the upper front layer to provide the appearance of a buttoned placket.

The placket may be constructed as a separate unit. The placket may be attached to the garment in a separate operation. This allows construction of the placket without having to manipulate the entire garment. In adaptive clothing, buttons are attached so that one side of a garment, such as a shirt, becomes an upper body front for male garments and attached so that the other side becomes the upper body front for female garments. Division of labor in flexibility in the manufacturing process is facilitated. An inventory of plackets may be maintained separately from an inventory of unfinished shirts. A single inventory of plackets may be maintained for two different models of shirts, i.e., male and female.

By constructing the placket separately, it is not necessary to manipulate an entire garment at the same time.

BRIEF DESCRIPTION OF THE DRAWINGS

The present subject matter may be further understood by reference to the following description taken in connection with the following drawings.

DETAILED DESCRIPTION

Figure 1:
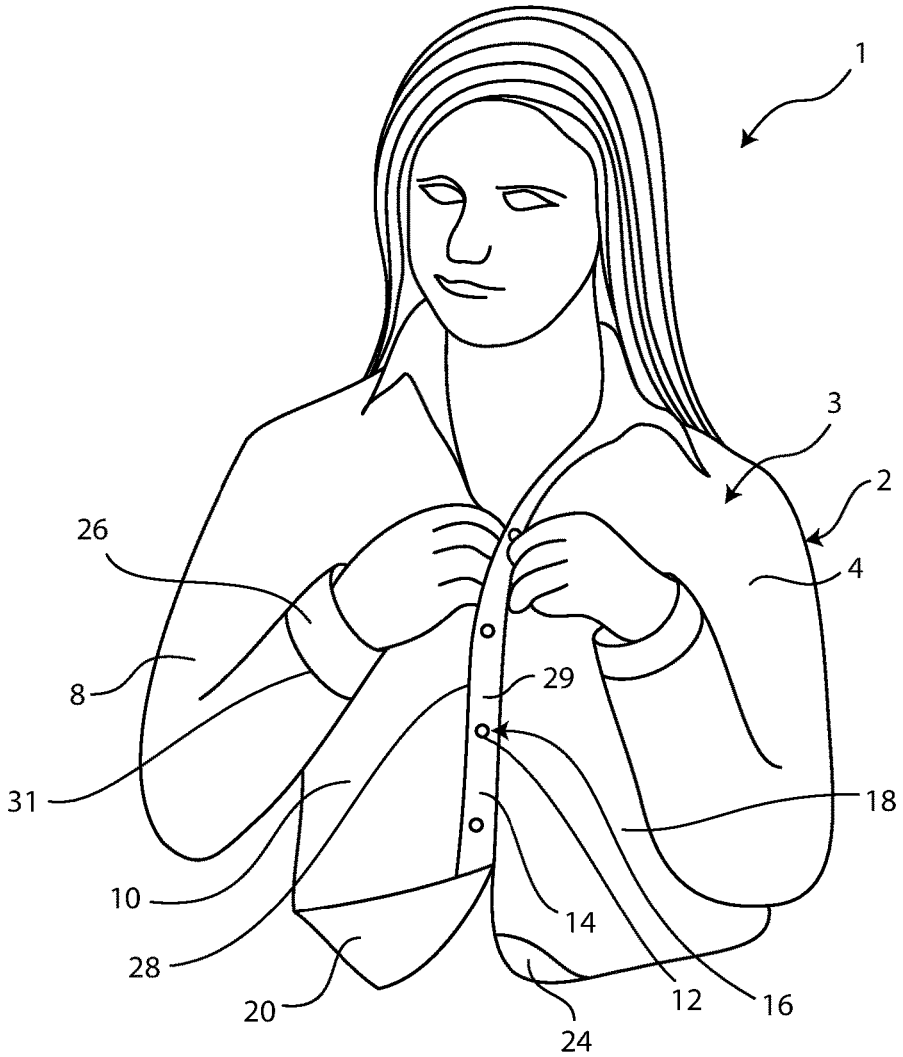
FIG. 1 is an illustration of a user closing an adaptive garment.

FIG. 1 illustrates a user 1 wearing a piece of adaptive clothing 2. In the present illustration, the piece of adaptive clothing 2 comprises a shirt 3 constructed of fabric 4. The term shirt is used to denote an upper body garment which could be, for example, a woman's blouse or a man's jacket. The present subject matter, however, is not limited to particular articles of apparel. The present subject matter is not limited to shirts or blouses. It is generally applicable to adaptive clothing, such as pants, dresses, or other articles of clothing.

The shirt 3 comprises a number of standard components. The outside layer of the front of the shirt 3 is called the upper body front 10. The shirt 3 has a sleeve 8. The upper body front 10 is the layer in which buttonholes are formed in conventional clothing. In adaptive clothing, buttons 12 are fixed to a placket 14 on the upper body front 10. Simulated buttonholes 16 are sewn at locations of each button 12. This arrangement gives the appearance that the buttons 12 have come through buttonholes in the placket 14. In conventional clothing, buttons 12 are fixed to a lower body front 18. An interior side of the upper body front 10 is the upper front facing 20. An interior side of the lower body front 18 is the lower front facing 24. The present subject matter may also be used in a cuff 26. References to the placket 14 also describe the cuff 26 except where logically impossible.

One end on the perimeter of the cuff 26 is analogous to the upper body front 10, and the other end of the perimeter is analogous to the lower body front 18. A cuff sewing line 31 attaches the cuff 26 to the sleeve 8. The cuff sewing line 31 is analogous to the sewing line 28. In most embodiments, a sewing line 29 is not used.

In one preferred form, the placket 14 is formed separately from the shirt 3. The placket 14 is attached to the upper body front 10 and along a sewn line 28. An edge sewn line 29 is provided substantially parallel to the sewn line 28 on an opposite side of the buttons 12. In this manner, the placket 14 may be formed without manipulation of the entire shirt 3. Also, the placket 14 may be attached to either side of the shirt 3. Consequently, only one inventory of plackets needs to be maintained for assembly of men's and women's shirts. This construction is further discussed with respect to FIG. 6 below.

In conventional garments, buttons are attached to one of two front facings for male garments and attached to the other front facing for female garments. The placket 14 may be selectively attached to the "male" side of the shirt or the "female" side of the shirt. Division of labor in flexibility in the manufacturing process is facilitated. An inventory of plackets 14 may be maintained separately from an inventory of unfinished shirts. A single inventory of plackets 14 may be maintained for two different models of shirts, i.e., male and female.

Figure 2:
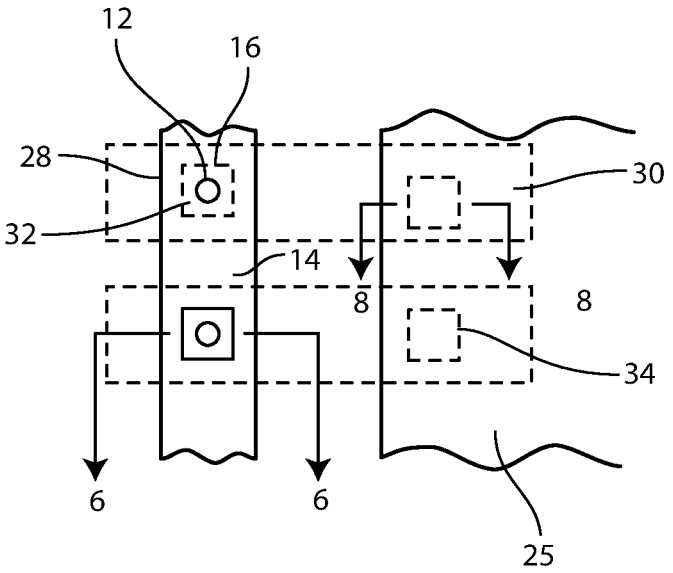
FIG. 2 is a partial detailed view of FIG. 1 illustrating closure members.

FIG. 2 is a partial detailed view of FIG. 1 illustrating closure members. In the present illustration, the front of the shirt 3 (FIG. 1) is closed by pairs of fasteners 30. Each pair of fasteners 30 comprises an upper fastener 32 and a lower fastener 34. The pairs of fasteners 30 include magnets in place of buttons, snaps, or Velcro. In one preferred embodiment, each lower fastener 34 is fixed to the lower front facing 25. The locations of the upper fasteners 32 and lower fasteners 34 are illustrated in phantom lines. Each button 12 is sewn to fabric in registration with the upper fastener 32.

Figure 3:
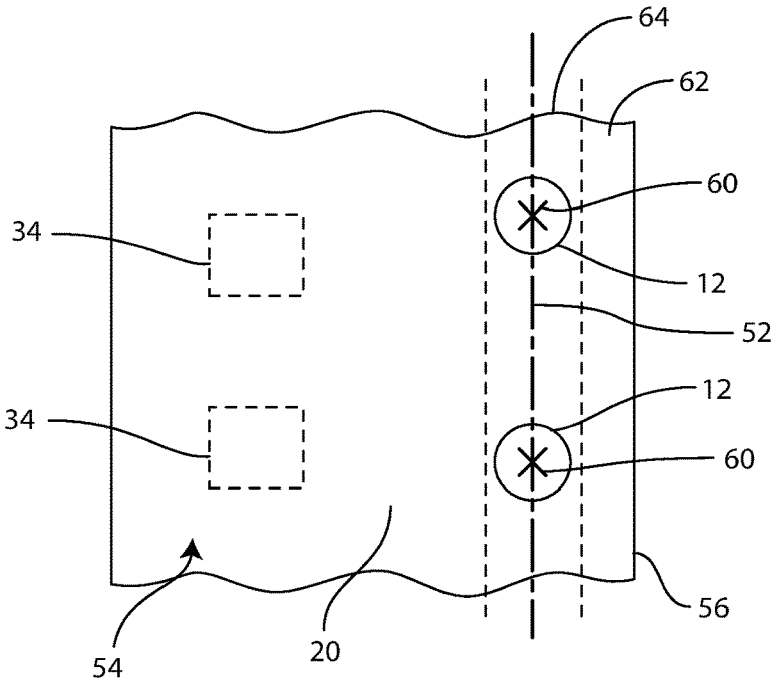
FIG. 3 is a plan view of an initial stage in the construction of a placket.

FIG. 3 is a plan view of an initial stage in the construction of the placket 14 (FIG. 1). Positioning of upper fastener members 32 (FIG. 4) with respect to buttons 12 is illustrated. FIG. 3 also illustrates the edge of a shirt which may or may not have a placket 14. FIG. 3 is "flipped over" a horizontal axis with respect to FIG. 4. Buttons 12 are affixed to a section 52 of fabric 54 with sewing thread 60. The section 52 is located at the upper front facing 20. The section 52 and fabric 54 have a common edge 56. The buttons 12 are aligned in a button column 62 defined by a button axis 64. The buttons 12 need not necessarily be placed directly on the button axis 64. Each upper fastener 32 is shown in phantom lines.

Figure 4:
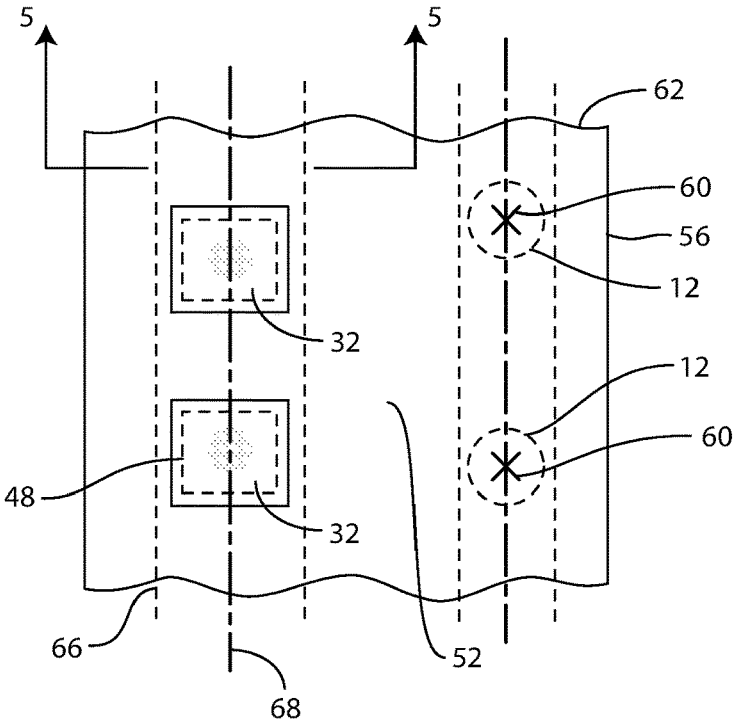
FIG. 4 is a plan view of a surface opposite the surface illustrated in FIG. 3.

FIG. 4 is a plan view of a surface opposite the surface illustrated in FIG. 3. This plan view illustrates one section 52 of the piece of fabric 54 (FIG. 3) illustrating the button columns 62 and magnet column 66 in the placket 14. FIG. 4 is a plan view of the fabric section 52. The upper fasteners 32 are placed in an upper fastener column 66. The upper fasteners 32 are placed on or adjacent an upper fastener axis 68. Each upper fastener 32 is secured by sewing thread 48. After the section 52 is assembled, the section 52 is folded on a fold line 70 (FIG. 6) so that the button column 62 is in registration with the upper fastener column 66. As further explained below with respect to FIG. 6 the section 52 will be folded such that the axes 64 and 68 will be substantially in registration.

Figure 5:
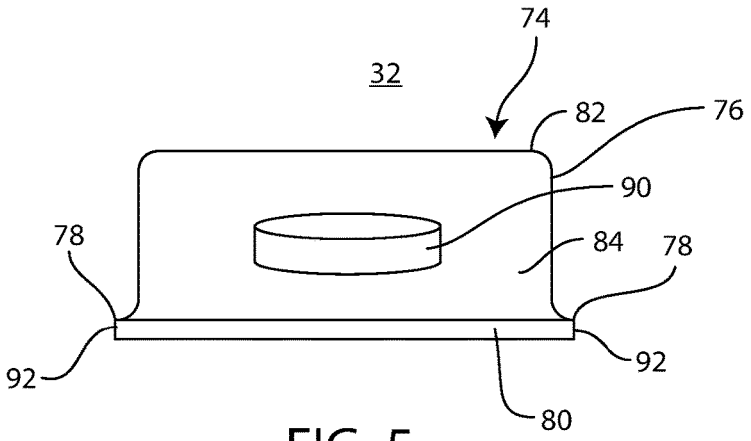
FIG. 5 is a partial cross-sectional view of an upper fastener taken along lines 5-5 of FIG. 4 showing one form of magnet assembly included in the upper fastener.

FIG. 5 is a partial cross-sectional view of an upper fastener 32 taken along lines 5-5 of FIG. 4 showing one form of upper magnet assembly 74 included in the upper fastener 32. The upper magnet assembly 74 comprises a housing 76. The housing 76 comprises a base 80 and a cap 82 either attached to or unitary with the base 80 in order to define a chamber 84. The base 80 preferably comprises a regular polygon having corners 78. In one preferred form, the base 80 comprises a square. A magnet 90 is retained in the chamber 84 of the housing 76. The magnet 90 may be secured to the cap 82, the base 80, or both with adhesive. Alternatively, the cap 82 may be shrunk to press the magnet 90 against the base 80. In one preferred form, the magnet 90 is vacuum-sealed inside there, with all four sides of the housing 76 around the magnet 90, so that the magnet itself is still loose inside the chamber and directly not compromised.

The magnet 90 is selected on the basis of strength of magnetic attraction, size, and cost. It is important for the lower fastener 34 and the upper fastener 32 to keep the shirt 3 closed while still being easily separated from each other by the user 1. Additional factors include the thickness of the fabric 4. The coefficient of friction of the fabric 4 is significant since the upper body front 10 and lower body front 18 can slide apart. Silk will have a relatively low coefficient of friction, while flannel will have a relatively high coefficient of friction.

The housing 76 may comprise any of a number of materials. Optimization for material selection takes into account strength, ease of penetration by a sewing needle or other means of fastening, and flexibility. Many different polymeric materials may be used. The base 80 is fixed to the lower front facing 24 (FIG. 1). One preferred method of fixing the base 80 to the lower front facing 24 is by sewing around the perimeter of the housing 76 substantially parallel to edges of the base 80. Alternatively, fastening of the base 80 to the lower front facing 24 may be accomplished at corners 78 with sewing thread 92. While most adhesives currently available are generally unsuitable, it is foreseeable that adhesives which are reliable for maintaining the upper fastener 32 in engagement with the lower front facing 24 will become more widely available. Alternatively, fastening may be accomplished at the corners 78.

Figure 6:
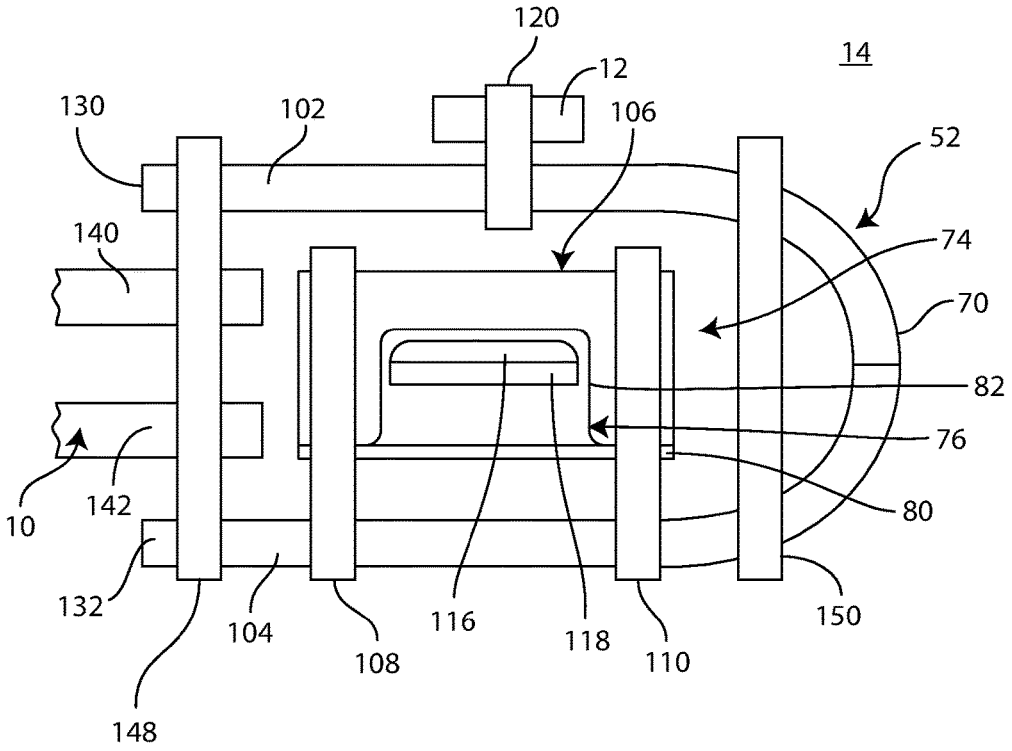
FIG. 6 is an exploded cross-sectional view taken along lines 6-6 of FIG. 2 showing one form of the placket.
Figure 7:
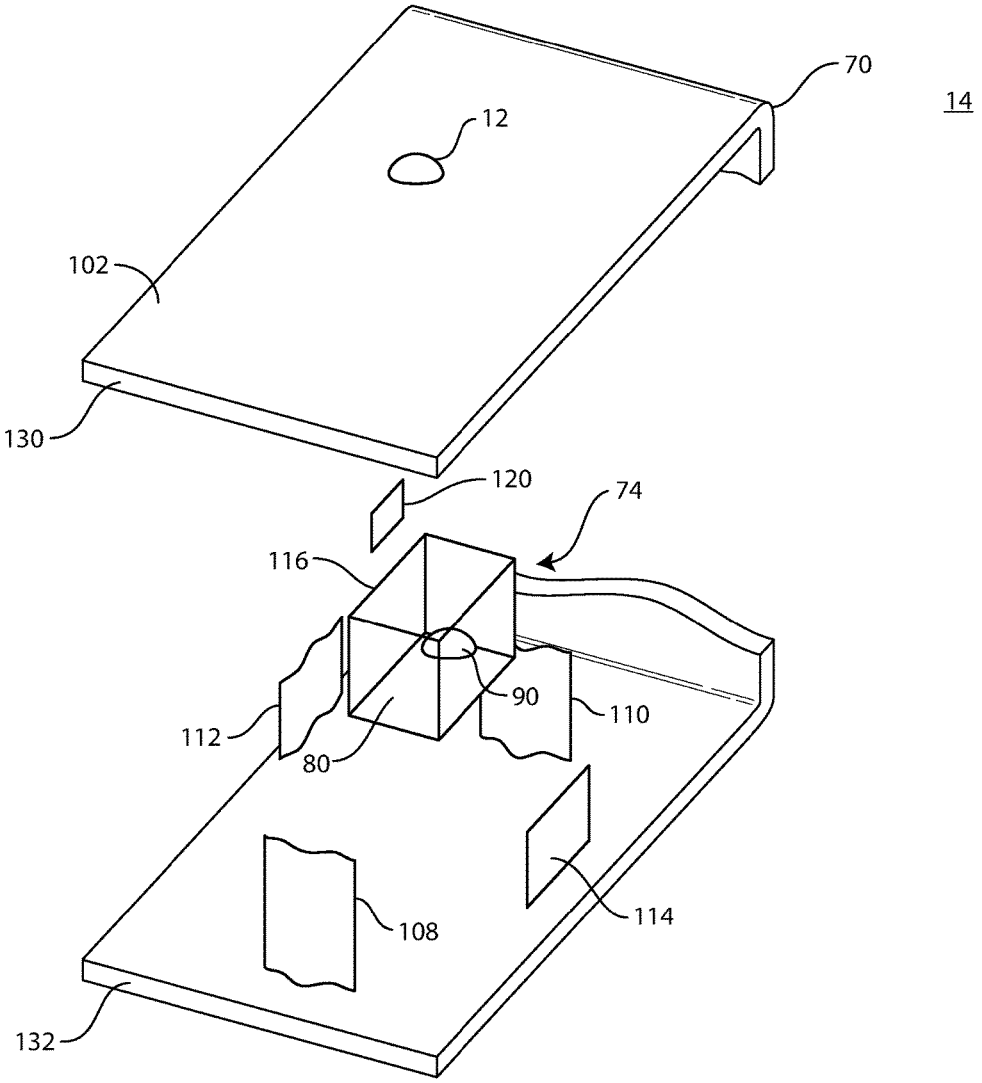
FIG. 7 is a view of the components of FIG. 6 in unassembled form.

FIG. 6 is an exploded cross-sectional view taken along lines 6-6 of FIG. 2 showing one form of placket 14. FIG. 7 is a view of the components of FIG. 6 in unassembled form. FIG. 6 and FIG. 7 are taken together. In this embodiment, the placket 14 is constructed separately from the shirt 3. The placket 14 is fastened to the upper body front 10 as seen in FIG. 1. By providing a separate placket 14, the placket 14 can be attached to either a left edge or a right edge of the shirt 3. Therefore, a male garment or a female garment may be constructed using a common inventory of plackets 14. Additionally, the placket 14 may be conveniently constructed by itself without having to have the entire shirt 3 in the workspace.

The placket 14 comprises the section 52 of FIG. 3 and FIG. 4. A portion of the section 52 on one side of the fold line 70 comprises a button section 102, which is an outermost fold. An interior section 104 is a portion of the section 52 on the side of the fold line 70 which will face the body of the wearer 1 and comprises an innermost fold. In the shirt embodiment, the fold line 70 indicates a location where a fold will be made. It is not part of the section 52. In a cuff embodiment, fold line 70 indicates a division between two separate pieces. In one preferred embodiment, the cuff placket 14 comprises two separate pieces but the front shirt placket 14 does is not.

Figure 8:
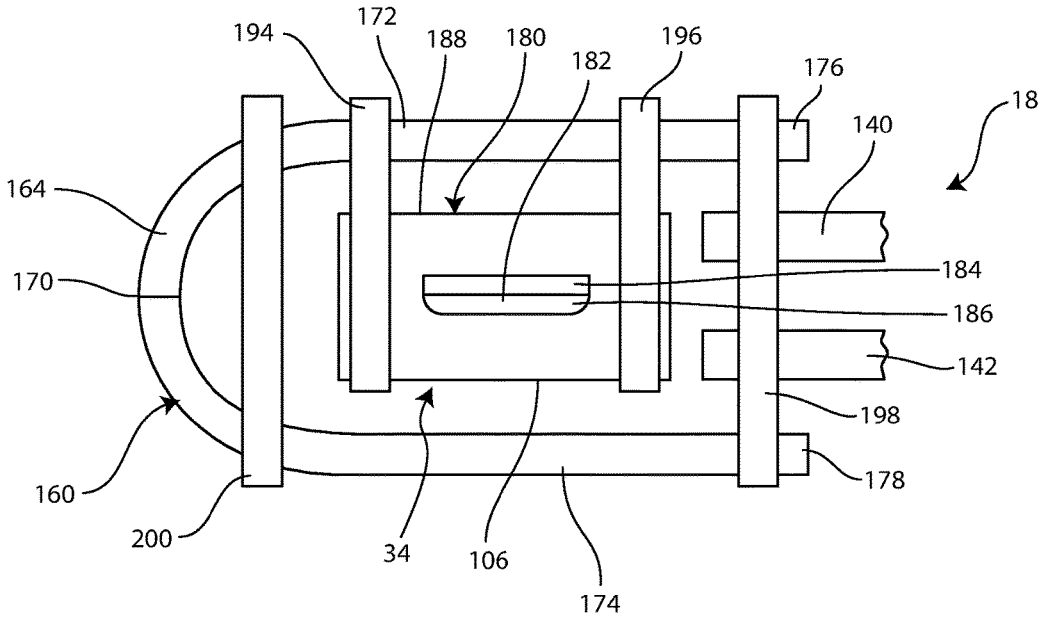
FIG. 8 is a cross-sectional view of an embodiment of a lower body front.

The upper magnet assembly 74 is secured to the interior section 104. The upper magnet assembly 74 is disposed between the interior section 104 and the button section 102. In this embodiment, the housing 76 comprises a container 106. The container 106 preferably includes the base 80 and the cap 82. Alternatively, as illustrated in FIG. 8, the container 106 is in the shape of a rectangular parallelepiped. The container 106 is secured to the lower section 104 by a first container stitch 108 and a second container stitch 110. The container 106 in one preferred form is a plastic pouch. A third container stitch 112 and fourth container stitch 114 (FIG. 7) are formed to fasten the remaining two sides of the container 106. The container stitches 108, 110, 112 and 114 each go through the container 106. The magnet 90 has an upper magnet layer 116 and a lower magnet layer 118. The upper magnet layer 116 is nonmagnetic. The lower magnet layer 118 is magnetic. In a further embodiment, the magnet 90 includes only the lower magnet layer 118. In another embodiment the container 106 comprises the upper magnet assembly 74.

The button 12 is secured to the button section 102 by button stitches 120. The button section 102 ends at an upper edge 130. The interior section 104 ends at a lower edge 132. The lower edge 132 is preferably in registration with the upper edge 130. In one preferred form, the upper edge 130 and the lower edge 132 are not fastened together prior to fastening to the shirt 3.

In order to attach the placket 14 to the shirt 3, a first facing 140 is placed between the button section 102 and the interior section 104 and projects into the placket 14 past the upper edge 130 and the lower edge 132. The first facing 140 will generally be an upper front facing. Additionally, an optional lining 142 may be placed in registration with the first facing 140. These components are secured by edge stitching 148. The edge stitching 148 may form the sewn line 28 of FIG. 1. A fold end stitching 150 is substantially parallel to the edge stitching 148 and adjacent the fold line 70. The fold end stitching 150 gives a finished look to the edge side of the placket 14.

FIG. 8 is an exploded cross-sectional view taken along lines 8-8 of FIG. 2 showing the lower fastener 34 in an end assembly 160 of the lower body front 18. In this embodiment, the end assembly 160 is constructed separately from the shirt 3. The end assembly 160 is fastened to the lower body front 18 as seen in FIG. 1. By providing a separate end assembly 160, the end assembly 160 can be attached to either a left edge or a right edge of the shirt 3. Therefore, a male garment or a female garment may be constructed using a common inventory of end assemblies 160. Additionally, the end assembly 160 may be conveniently constructed by itself without having to have the entire shirt 3 in the workspace.

The end assembly 160 comprises an end fabric piece 164. The end assembly 160 is folded on an end fold line 170. A portion of the end fabric piece 164 on one side of the end fold line 170 comprises an end upper section 172. An end interior section 174 is a portion of the end fabric piece 164 on the side of the end fold line 170 which will face the body of the wearer 1.

Figure 9:
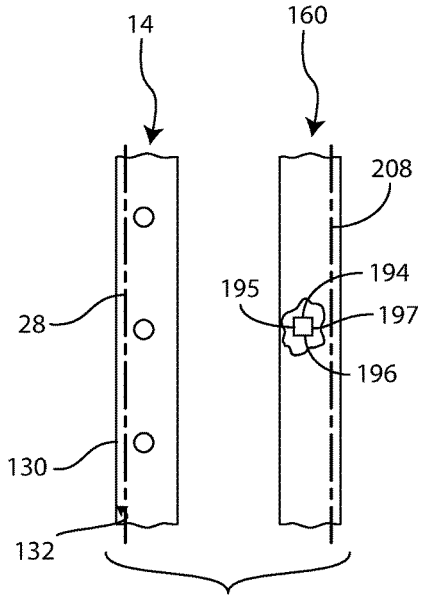
FIG. 9 illustrates the placket constructed separately from a shirt.

The lower fastener 34 comprises a lower magnet assembly 180 which is secured to the end upper section 172. The lower magnet assembly 180 is disposed between the end upper section 172 and the end interior section 174. The lower magnet assembly 180 includes a lower magnet 182. In this embodiment, the lower magnet assembly 180 comprises a container 188. In this embodiment, the container 188 is a rectangular parallelepiped. The container 188 is secured to the end upper section by a first sewing stitch 194 and a second sewing stitch 196. The first and second sewing stitches 194 and 196 go through the container 188. Additionally, a third sewing stitch 195 and a fourth sewing stitch 197 are provided to complete a perimeter around the magnet assembly 180. FIG. 9 is partially broken away to illustrate the sewing stitches 194 through 197. In other forms, a continuous stitching may be provided around the magnet assembly 180. The lower magnet 182 has a magnetic layer 184 and a nonmagnetic layer 186. In a further embodiment, the lower magnet 182 includes only the magnetic layer 184.

In order to attach the end fabric piece 164 to the shirt 3, an opposite end of the first facing 140 is placed between the end upper section 172 and the end interior section 174 and projects into the end fabric piece 164 past an end upper section edge 176 and an end interior section edge 178. The first facing 140 will generally be an upper front facing. Additionally, the optional lining 142 may be placed in registration with the first facing 140. These components are secured by edge stitching 198. Fold stitching 200 is provided at an opposite end of the lower magnet assembly 180.

FIG. 9 illustrates a placket 14 and an end assembly 160 each constructed separately from the shirt 3. The relative positions of the placket 14 and the end assembly 160 may be reversed to allow for construction of a garment for a male or female. In FIG. 9 the placket 14 may be closed. In one form, the edges 130 and 132 are left unfastened to each other. The placket 14 may be kept in inventory in this state. The ends of the button section 102 and interior section 104 (FIG. 6) receive the edge of the upper body front 10. The sewn line 28 is formed in the position of the edge stitching 148 seen in FIG. 6. Alternatively, the edge stitching 148 may be provided before the placket 14 is attached to the upper body front 10. The placket 14 may be attached later to the upper body front 10 by a separate sewn line 28

In FIG. 9 the end assembly may be closed. In one form, the end upper section edge 176 and the end interior section edge 178 are left unfastened to each other. The end assembly 160 may be kept in inventory in this state. The ends of the end upper section 172 and the end interior section 174 (FIG. 8) receive the edge of the lower body front 18. A sewn line 208 is formed in the position of the edge stitching 198 seen in FIG. 8. Alternatively, the edge stitching 198 may be provided before the end assembly 160 is attached to the lower body front 18. The end assembly 160 may be attached later to the lower body front 18 by a separate sewn line 208.

By constructing the placket 14 or the end assembly 160 separately, it is not necessary to manipulate the entire shirt 3 at the same time. An inventory of plackets 14 or end assemblies 160 may be maintained separately from an inventory of unfinished shirts. A single inventory of plackets may be maintained for two different models of shirts, i.e., male and female.

In the shirt 3, buttons 12 are attached so that one side of the shirt 3 becomes the upper body front 10 for male garments and attached so that the other side becomes the upper body front 10 for female garments. The placket 14 and the end assembly 160 may each be selectively attached to the "male" side of the shirt 3 or the "female" side of the shirt 3.

Figure 10:
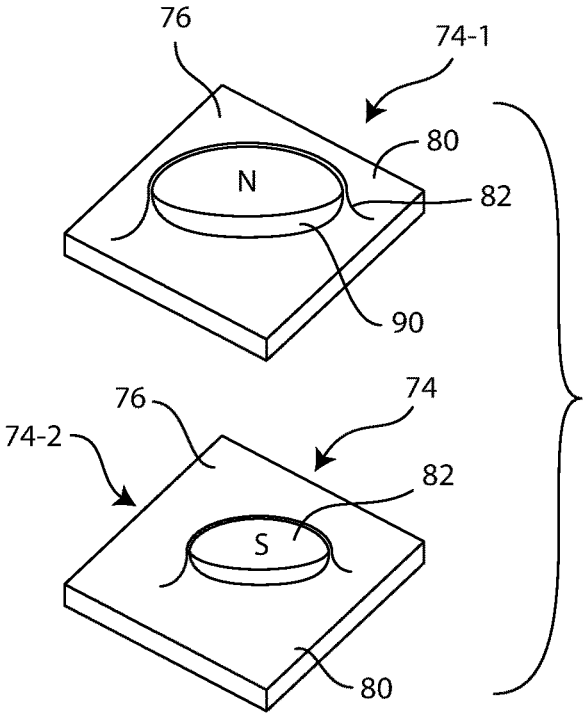
FIG. 10 is an isometric view of one preferred form of magnet assembly.
Figure 11:
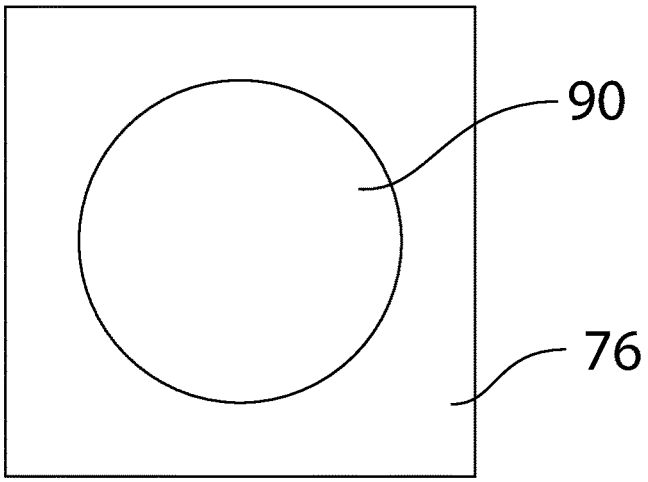
FIG. 11 is a plan view of the magnet assembly of FIG. 10.

FIG. 10 is an isometric view of one preferred form of magnet assembly 74. FIG. 11 is a plan view of the magnet assembly 74. FIGS. 10 and 11 are taken together. Upper magnet assemblies 74-1 and 74-2 each comprise a magnet assembly 74 having a particular polarity. Magnet assemblies 74-1 and 74-2 may be purchased in pairs. Upper magnet assembly 74-1 is a magnet having north polarity and upper magnet assembly 74-2 is a magnet having south polarity. The upper magnet 90 and the lower magnet 182. must be of opposite polarities so that they will attract each other. In one preferred form, the magnet 90 is a strong neodyium rare earth magnet. The housing 76 comprises a PVC plastic pouch which may be square or round or comprise a regular or irregular polygon. The housing 76 helps prevent tearing and pulling forces over the base 80. This helps prevent the magnets from tearing through the fabric 54 (FIG. 3). The housing 76 is waterproof and prevents damage to magnet assemblies 74 during successive washes. Many other specific forms of magnet assemblies may be provided that are consistent with the structure and performance taught herein.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of construction described herein may be changed and are not limited to the manner described herein. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible.

What is claimed is:

1. An article of adaptive clothing comprising an upper front layer for fastening to a lower front layer and which is closed by placing an end of the upper front layer over an end of the lower front layer comprising:

a placket for fixing to an upper body front, the placket comprising fabric and having an end extending in a longitudinal direction and having a fold extending in a transverse direction over a predetermined length of a lower surface of the placket;

at least one upper magnet assembly fastened to said lower surface comprising an upper magnet in a housing, the housing comprising a flat base, the base having sufficient strength to prevent tearing and pulling forces of the fabric, said magnet housing further comprising a cap surrounding said magnet and being fixed to said base;

a button affixed to an outer surface of a section of said upper body front substantially in registration with said magnet;

a first sewing line and a second sewing line each extending in the longitudinal direction on opposite sides of the magnet assembly, said section and said first and second sewing lines comprising a placket.

2. An article of adaptive clothing according to claim 1 further comprising the lower front layer.

3. An article of adaptive clothing according to claim 2 further comprising at least a lower magnet assembly positioned to be in registration with said at least one upper magnet when said article of adaptive clothing is closed and wherein a maximum of two layers of fabric is disposed between said at least one upper magnet and a magnet in said lower magnet assembly.

4. An article of adaptive clothing according to claim 3 wherein said at least one upper magnet comprises a plurality of magnets spaced in a longitudinal direction along said placket.

5. An article of adaptive clothing according to claim 4 wherein said placket is fixed to said upper body front.

6. An article of adaptive clothing according to claim 5 wherein said magnet is fixed to said cap by adhesive.

7. An article of adaptive clothing according to claim 5 wherein said housing and said cap comprises a rectangular parallelepiped.

8. An article of adaptive clothing according to claim 6 wherein said upper front is fixed to said placket by said first sewing line.

9. An article of adaptive clothing according to claim 5 wherein said placket is fixed to said upper front by a third sewing line.

10. A method of making an article of adaptive clothing comprising providing a garment including first and second body fronts, and providing a placket including upper fastening members;

selecting one said body front to be an upper body front, and the other said body front to be a lower body front;

fixing one side of a placket to the upper body front;

providing a magnet assembly comprising a substantially planar base and a cap surrounding a magnet and sewing the magnet assembly to said placket, placing stitches in the substantially planar base outside of a perimeter of the cap;

fixing a button to said placket substantially in registration with the magnet assembly inside said placket;

forming said lower body front including magnets to be in registration with respective magnets in the placket.

11. A method according to claim 10 wherein fixing one side of the placket to the upper body front comprises inserting a facing into an opening between upper and lower layers of a placket and closing the placket together with the facing with a sewing line.

12. A method according to claim 10 wherein said placket is closed by a sewing line and wherein said placket is fixed to the upper body front with a separate sewing line.

13. A method according to claim 10 wherein said placket comprises a cuff and wherein the step of fixing the button to the placket comprises sewing the button in registration with a magnet in the interior of the cuff.

14. A method according to claim 13 wherein fixing the placket to the upper body front comprises fixing the cuff to a perimeter at an end of a sleeve.

15. An article of adaptive clothing comprising:

an upper front and a lower front, each having an end to be brought in registration with an end of the other front;

said upper front having a surface comprising an upper front facing and said lower front having a surface comprising a lower front facing;

the upper front and the lower front comprising folds at an end of a side of the article of adaptive clothing to be closed;

first magnets included in said fold of said upper front and second magnets included in said fold of said lower front;

a housing enclosing each said first magnet, said housing having a planar base fixed to an interior of a lower surface of the fold of said upper front, and a cap supported to the base, the housing being affixed to relieve tensile stress on the lower surface of the fold.

16. An article of adaptive clothing according to claim 15 wherein said article of adaptive clothing comprises a shirt and said upper front comprises a discrete placket having upper and lower layers for surrounding upper and lower surfaces of an end of said upper front, said upper and lower layers being discrete from said end of said upper front.

17. An article of adaptive clothing according to claim 16 wherein said magnet is loose within its respective housing.

18. An article of adaptive clothing according to claim 17 wherein ends of said placket are fastened by a sewing line and wherein said placket is affixed to said upper front facing by an additional sewing line.

19. An article of adaptive clothing according to claim 15 wherein said article of adaptive clothing comprises a cuff having ends of said placket fixed to a sleeve by a sewing line and further comprising a lining in said sleeve fixed by said sewing line.

20. An article of adaptive clothing according to claim 16 wherein said placket comprises a cuff.

* * * * *